US005445216A

United States Patent [19]

Cannata

[11] Patent Number: 5,445,216

[45] Date of Patent: Aug. 29, 1995

[54] HEAT EXCHANGER

[76] Inventor: Antonio Cannata, 14 Patience Crescent, London, Ontario, Canada, N6E 2K9

[21] Appl. No.: 209,645

[22] Filed: Mar. 10, 1994

[51] Int. Cl.[6] ..... F25B 3/00

[52] U.S. Cl. ..... 165/88; 165/120; 165/165

[58] Field of Search ..... 165/88, 120, 121, 164, 165/165

[56] References Cited

U.S. PATENT DOCUMENTS

| | | | |
|---|---|---|---|
| 104,180 | 6/1870 | McMillan . | |
| 731,469 | 6/1903 | Pontois . | |
| 1,110,065 | 9/1914 | Linga . | |
| 1,193,844 | 8/1916 | Tacy . | |
| 1,945,287 | 1/1934 | Monroe | 257/216 |
| 2,088,734 | 8/1937 | Duran | 257/244 |
| 2,129,300 | 9/1938 | Bichowsky | 257/245 |
| 2,384,251 | 9/1945 | Hill | 230/209 |
| 3,241,743 | 3/1966 | Laing et al. | 165/88 X |
| 3,412,787 | 11/1968 | Milligan | 165/165 X |
| 3,642,062 | 2/1972 | Edmaier | 165/125 |
| 4,124,069 | 11/1978 | Becker | 165/164 |
| 4,503,902 | 3/1985 | Zolik | 165/47 |
| 4,852,642 | 8/1989 | Lee | 165/109 |
| 4,863,567 | 9/1989 | Raley | 202/182 |
| 5,000,254 | 3/1991 | Williams | 165/85 |
| 5,242,015 | 9/1993 | Saperstein | 165/163 |

*Primary Examiner*—John C. Fox
*Attorney, Agent, or Firm*—Baker & Daniels

[57] ABSTRACT

A wound plate heat exchanger includes a series of air cooling passages defined between the convolutions of its windings such that, when rotated about a longitudinal axis through the center of the windings, cooling air is drawn through the cooling air passages.

18 Claims, 7 Drawing Sheets

HEAT EXCHANGER

BACKGROUND OF THE INVENTION

1. Field of the Invention

The present invention relates to heat exchangers. More specifically, the present invention relates to wound plate heat exchangers.

2. Description of the Prior Art

Plate-type heat exchangers, sometimes referred to as lamella heat exchangers are known. The principle behind such heat exchangers is that efficient heat transfer is obtained with the fluid to be cooled arranged in relatively thin layers which contact a large heat exchange surface area, such as one or more plates.

Depending upon the application, it is often difficult or impossible to provide the necessary volume within which a plate-type heat exchanger can be located. Accordingly, wound plate heat exchangers have also been developed wherein the plates are wound into a spiral or the like.

U.S. Pat. No. 1,110,065 to Linga shows a wound plate heat exchanger wherein a thin chamber is divided into two regions and is wound into a spiral. Working fluid enters one of the regions at the outer edge of the spiral and moves inwardly to the inner edge of the spiral. At the inner edge, the working fluid enters the other region and moves outwardly to the outer edge of the spiral where it exits the heat exchanger. A cooling fluid, such as air, passes between the convolutions of the spiral to cool the working fluid.

U.S. Pat. No. 731,469 to Le Pontois shows another spiral wound plate heat exchanger wherein a single-region spiral chamber is arranged at the center of a cast annular inlet manifold. Working fluid enters the outer edge of the spiral from the inlet manifold and exists the inner edge of the spiral through a pipe-like outlet manifold. Cooling air is drawn or forced between convolutions of the spiral by a suitable means.

However, problems exist with existing prior art wound plate heat exchangers in that, in many circumstances, additional means are required to draw or force cooling air through the convolutions of the exchanger. In uses such as cooling systems for motor vehicles, a separate fan and/or duct work must be provided to ensure an adequate supply of cooling air to the heat exchanger. Further, if such a wound plate heat exchanger is employed to cool the engine coolant of a motor vehicle, separate provision would have to be made to supply cooling air to other heat exchange devices which may be present, such as an air conditioning condenser, oil cooler, etc.

SUMMARY OF THE INVENTION

It is an object of the present invention to provide a novel wound plate heat exchanger which obviates or mitigates at least some of the above-mentioned disadvantages.

According to one aspect of the present invention, there is provided a wound plate heat exchanger, comprising:

a fluid receiving chamber including first and second opposed edges and having at least first and second regions interconnected adjacent said first edge;

an inlet manifold at said second edge and connected to said first region;

an outlet manifold at said second edge and connected to said second region, said inlet and outlet manifold defining an axis;

a plurality of elongate induction fins extending substantially normally from a surface of said chamber and orientated at an angle from between about 10 degrees to about 80 degrees with respect to said axis, said chamber being wound about said longitudinal axis such that said induction fins define passages arranged between convolutions of said chamber;

first and second bearing members connected to a respective one of said inlet manifold and said outlet manifold such that said inlet and outlet manifolds and said chamber are rotatably mounted to said first and second bearing members; and drive means to rotate said chamber such that air is drawn through said passages.

BRIEF DESCRIPTION OF THE DRAWINGS

Embodiments of the present invention will be described, by way of example only, with reference to the accompanying drawings, in which.

DETAILED DESCRIPTION OF THE PREFERRED EMBODIMENTS

Figure 1:
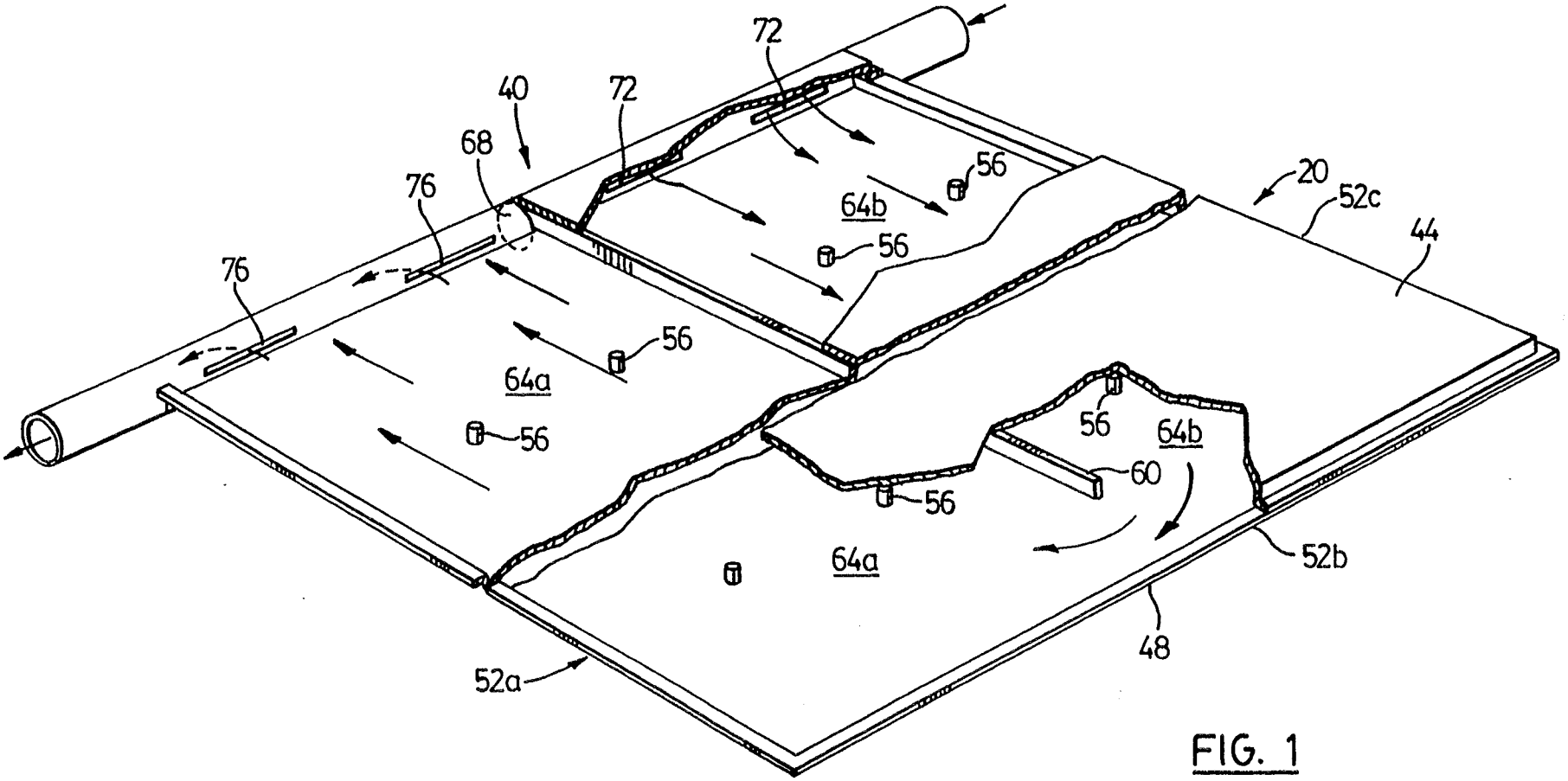
FIG. 1 shows a partial section of a two-region chamber and an inlet and an outlet manifold in accordance with the present invention.

FIG. 1 shows a heat exchange chamber 20 and a combined inlet and outlet manifold 40 in accordance with the present invention. In the preferred embodiment, chamber 20 is formed from a top sheet 44 and a bottom sheet 48 which are joined at three edges 52*a*, 52*b* and 52*c* by any suitable joining means such as soldering, welding, chemical bonding, etc. A plurality of spacers 56 are placed between top sheet 44 and bottom sheet 48 to maintain their relative spacing and a central member 60 extends across chamber 20 such that the interior of chamber 20 is divided into two regions 64*a* and 64*b*. Spacers 56 and central member 60 are fastened in place within chamber 20 by soldering, spot welding or any other suitable fastening means. Alternatively, spacers 56 and/or central member 60 may be formed by stamping either or both or top sheet 44 and bottom sheet 48 or by extruding or casting either or both top sheet 44 and bottom sheet 48 with the suitable features.

In the presently preferred embodiment, which is intended for use in cooling engine coolant for internal combustion engines in motor vehicles, the height of chamber 20 (i.e. the distance between top sheet 44 and bottom sheet 48) is selected to be approximately 5 mm. Of course in other applications, such as those wherein fluids other than water are to be cooled, the heating of chamber 20 may be varied appropriately as would be apparent to those of skill in the art.

The length of chamber 20 (i.e. the distance chamber 20 extends along manifold 40) and its width (i.e. the distance chamber 20 extends from manifold 40) are selected such that the cross-sectional area of chamber 20 which is presented to the flow of fluid to be cooled is large enough to accommodate the maximum flow and such that an adequate total area is provided over which heat exchange can occur.

Combined inlet and outlet manifold 40 is joined to the fourth side of chamber 20 by any suitable fastening means such as soldering or welding which results in a fluid-tight join of appropriate strength as would be apparent to those of skill in the art. As can be seen in the Figure, top sheet 44 is fastened to the top of manifold 40 (the twelve o'clock position if viewed from the end of the manifold at the left side of the Figure) while bottom sheet 48 is fastened to the side of manifold 40 (the three o'clock position if viewed from the same position). This arrangement is presently preferred to allow for a tighter initial curve when forming chamber 20 into a coil, as described below.

Manifold 40 includes a dividing member 68, which is any suitable plug as would be apparent to those of skill in the art, to separate inlet and outlet flows within manifold 40. Alternatively, Manifold 40 may be fabricated from two separate components, one comprising the inlet manifold and the other comprising the outlet manifold.

Inlet slots 72 and outlet slots 76 are formed through the side of respective portions of manifold 40 and connect to regions **64*b* and 64*a* respectively such that fluid entering manifold 40 is directed into region 64*b* of chamber 20 through inlet slots 72. This fluid flows through region 64*b*, past central member 60 and then through region 64*a*, into outlet slots 76 and out of manifold 40**.

Figure 2:
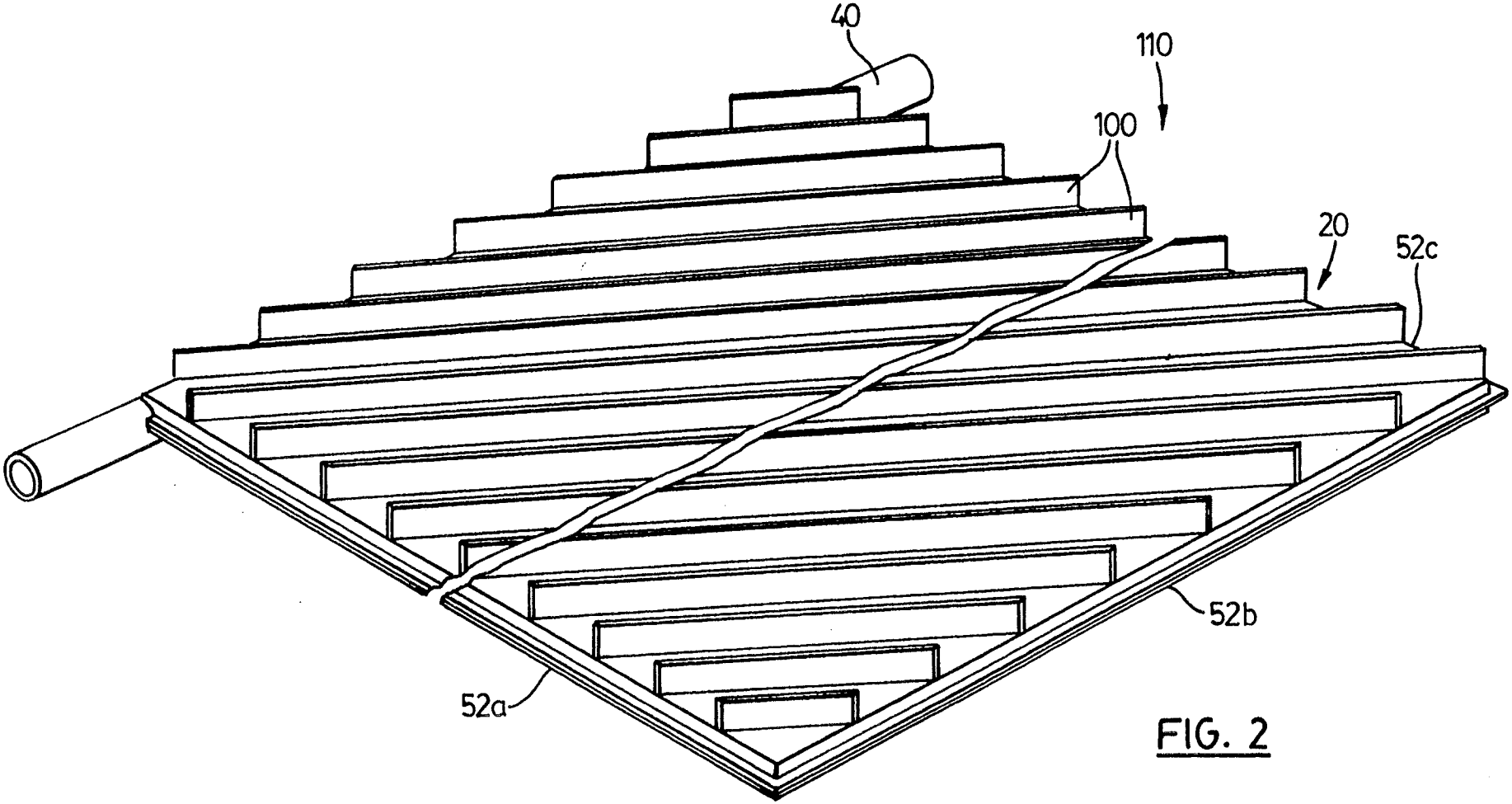
FIG. 2 shows the chamber of FIG. 1 with induction fins attached to the upper surface of the chamber.

As shown in FIG. 2, a series of upstanding induction fins 100 are attached to top sheet 44 by soldering, spot welding, or any other suitable attachment means as would be apparent to those of skill in the art, to form heat exchanger 110. Alternatively, top sheet 44 may be cast or extruded to include fins 100. Fins 100 are orientated at an angle with respect to the longitudinal axis of manifold 40 and, in the preferred embodiments, this is about a 45° angle although the actual angle employed is not particularly limited and in particular circumstances may be selected from a range of between about 10 degrees to about 80 degrees.

Heat exchanger 110 is next wound into a spiral about the longitudinal axis of manifold 40. While in the presently preferred embodiment chamber 20 is wound into a spiral, windings of other cross-sections such as parallelograms, etc. may be employed alternatively if desired.

Figure 3:
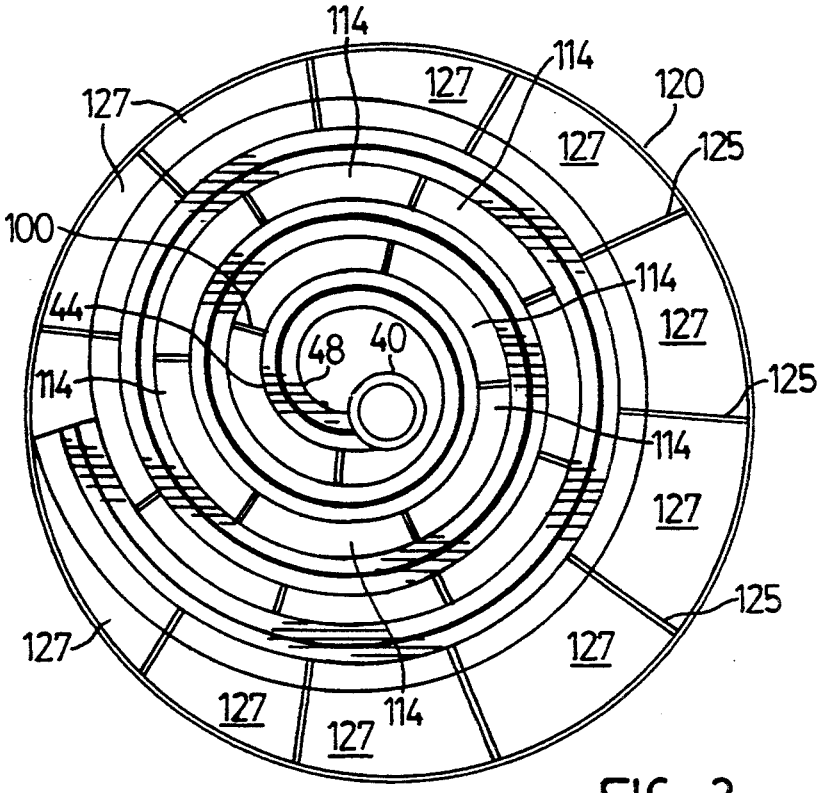
FIG. 3 shows a section through a spiral wound plate heat exchanger formed from the chamber of FIG. 2.
Figure 4:
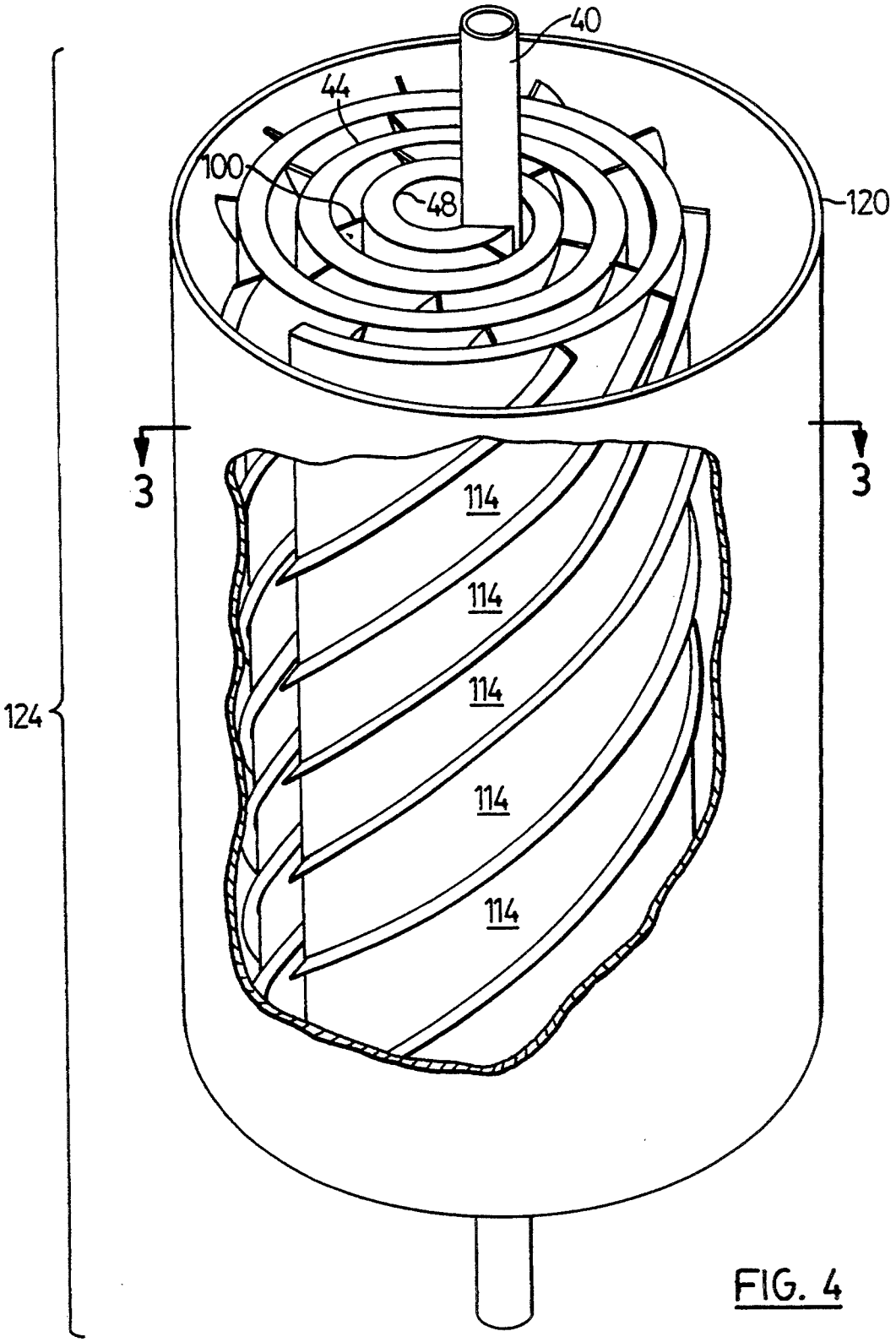
FIG. 4 shows a perspective, partially cut-away view of the heat exchanger of FIG. 3.

In the preferred embodiment, the spiral is formed with lower sheet 48 at the inside of each convolution, as shown in FIG. 3, and as can be seen in FIGS. 3 and 4, the free end of fins 100 of one convolution of the spiral abut lower sheet 48 of the next outer convolution of the spiral to form a series of helical air passages 114 between the convolutions of the spiral.

Figure 5:
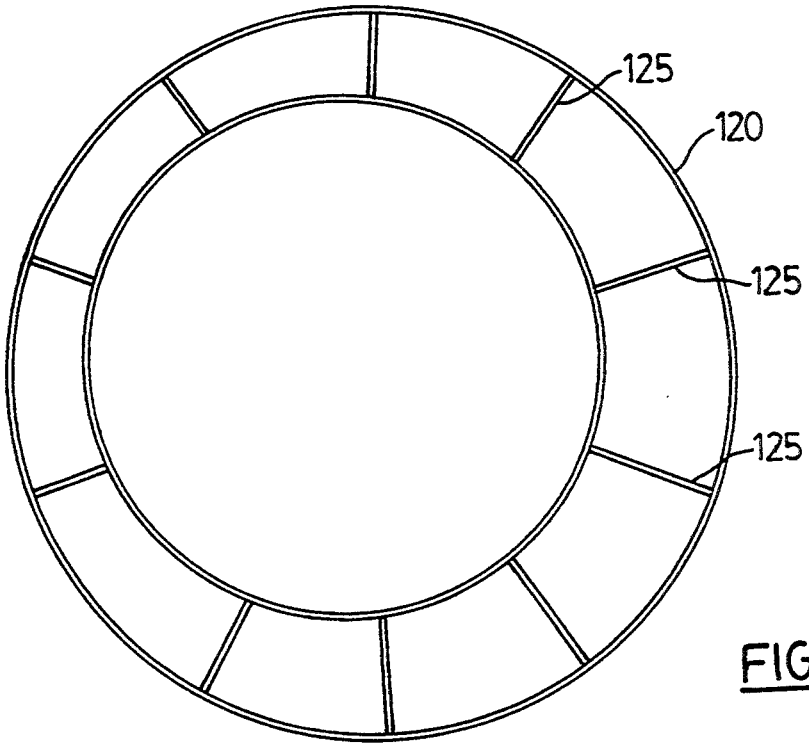
FIG. 5 shows a end view of an outer sheath used in the heat exchanger of FIG. 3.

As shown in FIGS. 3 and 4, in the presently preferred embodiment heat exchanger 110 is mounted in a tubular outer sheath 120 to form exchanger assembly 124. As shown in FIG. 5, outer sheath 120 includes a set of vanes 125 which extend radially inwardly and are helical along the longitudinal axis of outer sheath 120. Vanes 125 engages the fins 100 which extend from the outermost convolution of heat exchanger 110 such that vanes 125 and fins 100 form helical air passages 127 between the outer convolution of heat exchanger 110 and outer sheath 120.

In the presently preferred embodiment, outer sheath 120 is fabricated from a sheet, with vanes 125 upstanding, which is appropriately wrapped about heat exchanger 110 and then fastened in place by any suitable fastening means such as welding, soldering, chemical bonding, etc. Outer sheath 120 is intended to mechanically strengthen heat exchanger 110 and to assist in the formation of the additional cooling passages 127 as described above. It is however contemplated that in some circumstances, outer sheath 120 will not be required and may thus be omitted.

As can be seen in FIG. 3, as chamber 20 has been formed into a spiral about manifold 40, the rotational center of mass of exchanger assembly 124 will not be located at manifold 40. Accordingly, one or more balance weights (not shown) may be attached to or formed on outer sheath 120 to balance exchanger assembly 124. If outer sheath 120 has been omitted, the balance weights may be attached to the outside of heat exchanger 110 by any suitable means.

Figure 6:
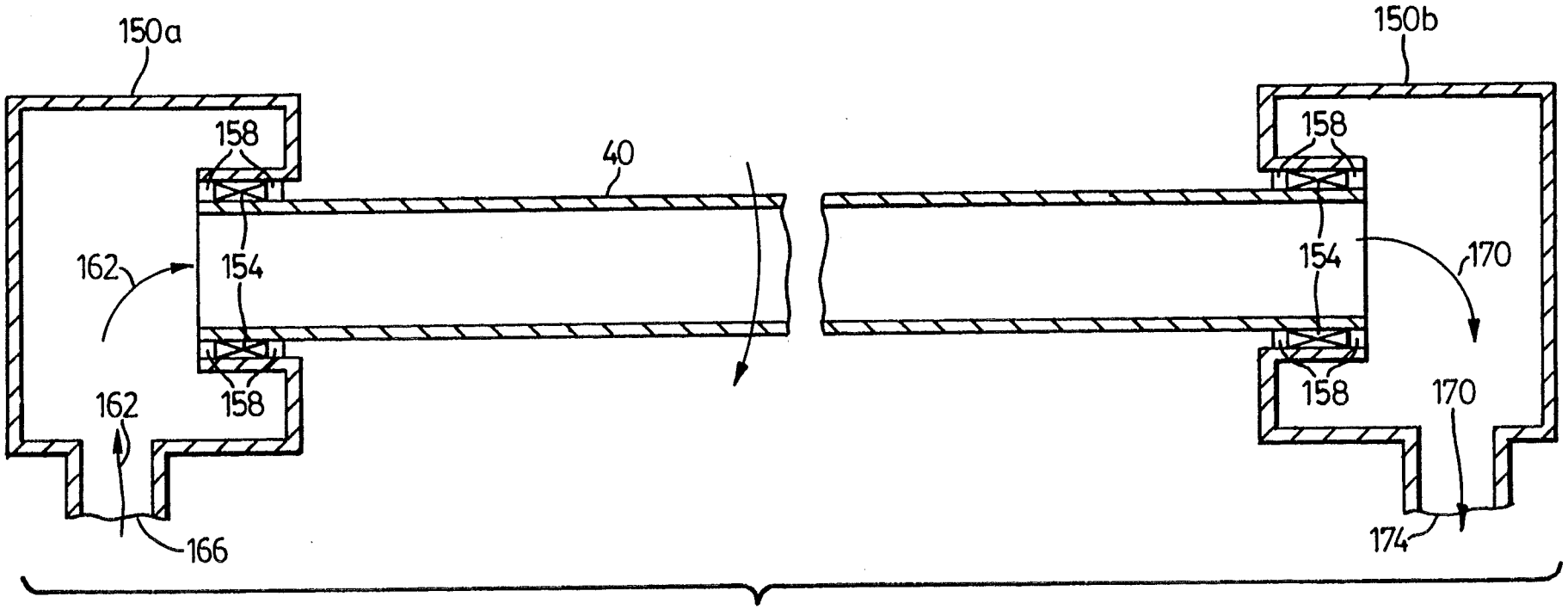
FIG. 6 shows a section of a pair of bearing housings for the heat exchanger of FIG. 3.

Each of the inlet and outlet ends of manifold 40 are mounted in a bearing housing **150*a*,150*b* (respectively) as shown in FIG. 6. Each bearing housing 150 includes a bearing 154 and one or more seals 158. Fluid to be cooled in heat exchanger 110 enters bearing housing 150*a* through port 166, as indicated by arrows 162, and enters the inlet end of manifold 40 which is free to rotate within bearing 154. Fluid which has been cooled within heat exchanger 110 exits the outlet end of manifold 40, as indicated by arrows 170, into bearing housing 150*b* and then exits bearing housing 150*b* through port 174**.

In use, heat exchanger 110 is rotated by a suitable drive means, as is discussed below in more detail. This rotation results in cooling air being drawn into and through helical passages 114 and 127 so that heat is transferred from the fluid to be cooled, which is passing through heat exchanger 110, to the cooling air travelling through passages 114 and 127. By rotating heat exchanger 110 to induce movement of cooling air through helical passages 114 and 127, the need for a separate cooling fan and/or a supply of ram air is eliminated.

Figure 7:
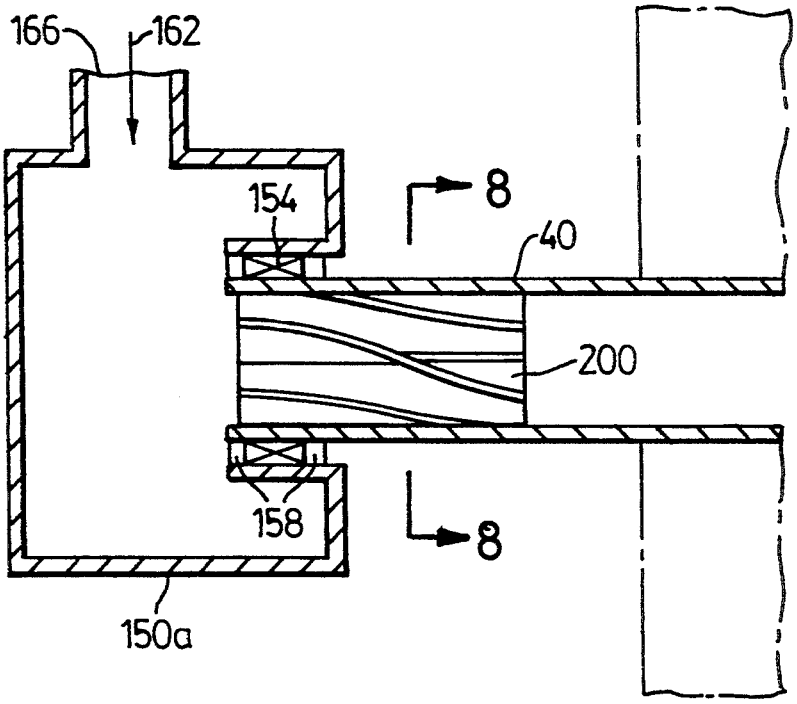
FIG. 7 shows another embodiment of a bearing housing for the heat exchanger of FIG. 3.
Figure 8:
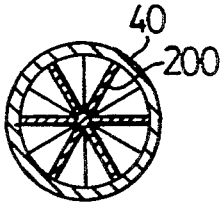
FIG. 8 shows a section taken along line 8—8 of FIG. 7.

FIG. 7 shows another embodiment of bearing housings **150*a* wherein an impeller 200 is placed within the inlet end of manifold 40. As shown in the Figure and in FIG. 8, impeller 200 includes a series of helical blades which are arranged such that, as heat exchanger 110 is rotated, impeller 200 will draw fluid from within housing 150*a* and into manifold 40. This reduces, or in some cases eliminates, the need for an external pump to force fluid through heat exchanger 110. In circumstances wherein additional pressure heat is required, for example to compensate for heat loss through heat exchanger 110, a second impeller (not shown) can be placed in the outlet end of manifold 40 within housing 150*b***.

It is contemplated that any suitable drive means may be employed to rotate heat exchanger 110. For example, in automotive applications heat exchanger 110 may be rotated by a pulley driven by a drive belt (in a manner similar to that conventionally employed to drive an alternator, etc.). Alternatively, a hydraulic or electric motor may be employed. If a hydraulic motor is employed, it is contemplated that it may advantageously be powered by an existing hydraulic pump such as a power steering pump or the like. As yet another alternative, electromagnets or permanent magnets may be attached to the exterior of outer sheath 120 to form the rotor of an electric motor and stator windings may be placed appropriately around outer sheath 120 such that exchanger assembly 124 itself acts as the rotor of the electric motor.

In another embodiment of the present invention, if adequate pressure heat of the fluid to be cooled is available, the operation of the bearing housing embodiment shown in FIG. 7 may be reversed such that pressure heat is used to rotate heat exchanger 110. Specially, impeller(s) 200 may be selected and sized such that they constitute the drive means and, as the fluid to be cooled moves into and out of manifold 40, impeller(s) 200 induce rotation of heat exchanger 110.

In heat exchanger applications such as automotive use, it is known to control the operation of a heat exchanger to accommodate changing requirements. Specifically, as an automotive engine is warming up, or while the ambient temperature is relatively low, automotive systems conventionally limit the flow of water through the heat exchanger by means of a temperature controlled flow valve. It is contemplated that such a flow valve may also be employed with heat exchangers in accordance with the present invention. However, it is contemplated that in many circumstances, it will be advantageous to stop the rotation of heat exchanger 110 either instead or of, or in addition to, limiting the flow of fluid to be cooled with a temperature controlled flow valve. In such circumstances, energy will no longer be required to rotate heat exchanger 110 and thus an energy savings will be realized.

It may often be the case that more than a single fluid need be cooled in a particular application. For example, in automotive applications while cooling engine coolant is the priority, it is often the case that transmission fluid, lubrication oil and/or air conditioner refrigerants also need to be cooled.

Figure 9:
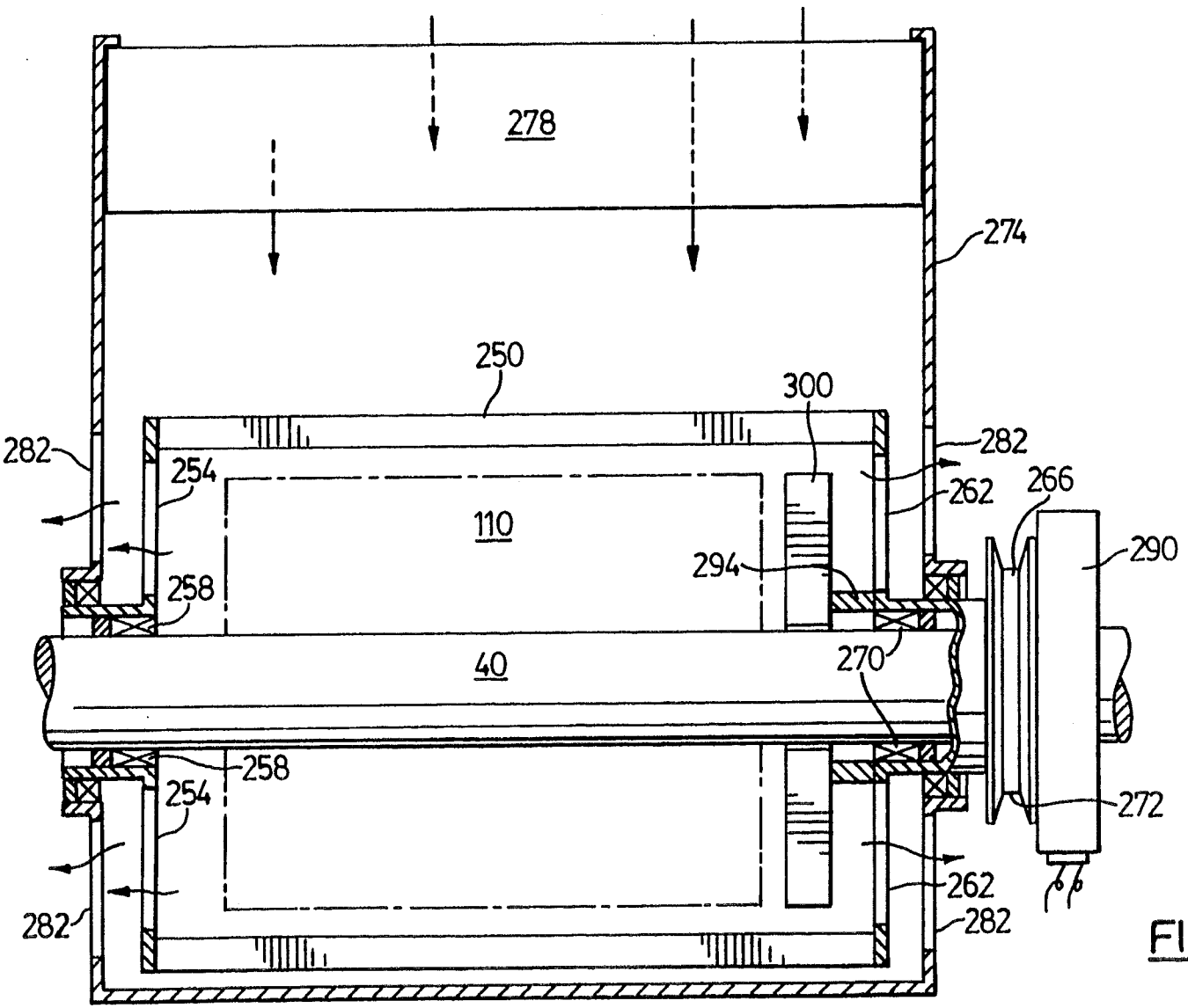
FIG. 9 shows another embodiment of a heat exchanger in accordance with the present invention.

FIG. 9 shows another embodiment of the present invention which is intended to provide a secondary airflow to conventional heat exchangers for cooling transmission fluid, etc. as desired. In this embodiment a drum, or squirrel-cage, fan 250 is coaxially mounted about heat exchanger 110. One end of fan 250 is connected by spokes 254 to bearings 258 which engage manifold 40. The other end of fan 250 is connected by spokes 262 to hub 266 which rides on bearings 270 on manifold 40. Hub 266 is connected to the drive means which, in the embodiment illustrated, is a belt-driven pulley 272 such that, as pulley 272 is rotated, fan 250 also rotates.

A shroud 274 encircles fan 250 with an air inlet opening 278 spaced from the longitudinal axis of manifold 40 and air outlet openings 282 adjacent the ends of heat exchanger 110. The pitch of the blades of fan 250 is preferably set so that air is drawn into shroud 274 through air inlet 278 and exits shroud 274 through air outlets 282. Conventional heat exchanger devices, such as transmission coolers or air conditioners condensers, are located adjacent air inlet 278 so that the cooling air which is drawn into air inlet 278 first passes through the conventional heat exchange devices.

To allow a supply of cooling air to conventional heat exchanger devices while still allowing the rotation of heat exchanger 110 to be started and stopped to meet primary cooling requirements, pulley 272 and hub 266 are isolated from manifold 40 so that heat exchanger 110 does not normally rotate with pulley 272. Instead, an electric clutch, in the form of an electromagnetic field coil 290 and an engagement 294, is provided to allow heat exchanger 110 to be engaged and disengaged with pulley 272 as desired. Specially, when field coil 290 is energized, engagement plate 294 is brought into engagement with hub 266 and thereby connects heat exchanger 110 to hub 266 such that heat exchanger 110 will commence rotation with pulley 272. Similarly, when field coil 290 is deenergized, engagement plate 294 disengages hub 266 and rotation of heat exchanger 110 ceases. Such electric clutches and the like are well known to those of skill in the art and are, for example, employed to provided intermittent engagement of air conditioning compressors in automotive environments. Accordingly, other variations of electric clutch will be apparent to those of skill in the art and will not be further described herein.

Also shown in FIG. 9 is an auxiliary fan 300. Auxiliary fan 300 is preferably a helical-vaned fan which is mounted to manifold 40 adjacent one end of heat exchanger 110. It is contemplated that, in circumstances wherein it is desired to increase the total airflow through heat exchanger 110, an auxiliary fan 300 may be provided adjacent either, or both, ends of heat exchanger 110. It will be apparent to those of skill in the art that auxiliary fan 300 may be employed with any of the embodiments of the present invention described above.

The present invention provides a novel wound plate heat exchanger where the heat exchanger is rotated in use, drawing cooling air through a series of passages between the convolutions of the windings. The present invention is thus self-inducing in operation and separately powered supplies of cooling air are not required.

While variations and embodiments of the present invention in addition to the preferred embodiments described above may occur to those of skill in the art, the scope of the present invention is intended to only be limited to the invention defined in the claims attached hereto.

What is claimed is:

1. A wound plate heat exchanger, comprising:

a fluid receiving chamber including first and second opposed edges and having at least first and second regions interconnected adjacent said first edge;

an inlet manifold at said second edge and connected to said first region;

an outlet manifold at said second edge and connected to said second region, said inlet and outlet manifold defining an axis;

a plurality of elongate induction fins extending substantially normally from a surface of said chamber and orientated ant an angle from between about 10 degrees to about 80 degrees with respect to said axis, said chamber being wound about said longitudinal axis such that said induction fins define passages arranged between convolutions of said chamber;

first and second bearing members connected to a respective one of said inlet manifold and said outlet manifold such that said inlet and outlet manifolds and said chamber are rotatably mounted to said first and second bearing members; and drive means to rotate said chamber such that air is drawn through said passages.

2. A heat exchanger according to claim 1 wherein said chamber is wound in the form of a spiral.

3. A heat exchanger according to claim 2 further comprising an outer substantially tubular sheath having a longitudinal axis and including helical vanes extending radially inwardly along said longitudinal axis, said longitudinal axis of said outer sheath being substantially coaxial with said axis defined by said inlet and outlet manifolds and said vanes engaging said fins of the outermost convolution of said spiral to define passages between the interior of said outer sheath and the outside of said spiral, said passages being arranged in a substantially helical manner.

4. A heat exchanger according to claim 3 wherein said outer sheath further comprises balance means to locate the rotational center of mass of the combined chamber and outer sheath about said axis.

5. A heat exchanger according to claim 1 wherein said first and second region are defined by a dividing member within said chamber.

6. A heat exchanger according to claim 1 wherein said drive means is an electric motor.

7. A heat exchanger according to claim 1 wherein said drive means is a hydraulic motor.

8. A heat exchanger according to claim 3 wherein said drive means is an electric motor and said outer sheath comprises the rotor of said electric motor.

9. A heat exchanger according to claim 1 further including a sensor to determine the temperature of fluid entering said heat exchanger and wherein said drive means is responsive to said sensor to activate and deactivate said drive means.

10. A heat exchanger according to claim 1 further including a valve to control the flow of fluid into said heat exchanger, said valve being closed when the temperature of the fluid entering said heat exchanger is below a predefined temperature.

11. A heat exchanger according to claim 1 further including a fan adjacent one end of said passages and rotating with said heat chamber to enchance movement of air through said passages.

12. A heat exchanger according to claim 1 further comprising: a drum fan encircling said chamber and being rotatable about said axis; and a shroud including an air inlet and an air outlet, said drum fan rotating with said chamber and drawing air from said air inlet to said air outlet.

13. A heat exchanger according to claim 12 wherein said drive means drives said drum fan.

14. A heat exchanger according to claim 13 further including means to disengage said chamber from said drum fan.

15. A heat exchanger according to claim 14 wherein said means to disengage is an electric clutch.

16. A heat exchange according to claim 1 further comprising at least one impeller means to draw water through said chamber, said at least one impeller means rotating with said chamber.

17. A heat exchanger according to claim 16 wherein said at least one impeller means being located within at least one of said inlet manifold and said outer manifold.

18. A heat exchanger according to claim 1 wherein said drive means comprises an impeller located within a flow of fluid to said heat exchanger, said impeller connected to said chamber such that flow of said fluid past said impeller induces rotation of said chamber.

* * * * *